US008181583B2

(12) United States Patent
Rivera, Jr. et al.

(10) Patent No.: US 8,181,583 B2
(45) Date of Patent: May 22, 2012

(54) MOBILE FOLDING TABLE WITH IMPROVED LOCKING AND LIFT-ASSISTING MECHANISMS

(75) Inventors: Jeremias C. Rivera, Jr., Elmhurst, IL (US); Doss Samikkannu, Des Plaines, IL (US); Gregory Hanusiak, Chicago, IL (US)

(73) Assignee: AmTab Manufacturing Corporation, Aurora, IL (US)

( * ) Notice: Subject to any disclaimer, the term of this patent is extended or adjusted under 35 U.S.C. 154(b) by 443 days.

(21) Appl. No.: 12/583,536

(22) Filed: Aug. 21, 2009

(65) Prior Publication Data

US 2011/0041738 A1 Feb. 24, 2011

(51) Int. Cl.
*A47B 3/00* (2006.01)

(52) U.S. Cl. ..... 108/168; 108/169; 297/158.4; 297/159.1

(58) Field of Classification Search ..... 108/166–169, 108/171–174, 115; 297/158.4, 159.1, 158.3, 297/157.1

See application file for complete search history.

(56) References Cited

U.S. PATENT DOCUMENTS

| | | | | | |
|---|---|---|---|---|---|
| 2,878,859 | A * | 3/1959 | Howe et al. | ..... | 297/158.4 |
| 3,191,991 | A * | 6/1965 | Anderson et al. | ..... | 297/158.4 |
| 3,212,463 | A * | 10/1965 | Anderson et al. | ..... | 108/168 |
| 4,026,221 | A * | 5/1977 | Wilson et al. | ..... | 108/169 |
| 4,027,600 | A * | 6/1977 | Mueller | ..... | 108/169 |
| 4,120,249 | A * | 10/1978 | Blink et al. | ..... | 108/174 |
| 4,133,271 | A * | 1/1979 | Carlson | ..... | 108/174 |
| 4,949,649 | A * | 8/1990 | Terres et al. | ..... | 108/116 |
| 6,065,802 | A | 5/2000 | Bue | | |
| 6,223,661 | B1 | 5/2001 | Griepentrog | | |
| 6,386,628 | B2 | 5/2002 | Bue | | |
| 6,644,221 | B2 | 11/2003 | Griepentrog | | |
| 7,032,524 | B1 | 4/2006 | Pajerski | | |
| 7,171,911 | B1 | 2/2007 | Rivera, Jr. et al. | | |
| 7,490,562 | B2 * | 2/2009 | Cornilleau | ..... | 108/168 |
| 2007/0199484 | A1 | 8/2007 | Rivera et al. | | |

* cited by examiner

*Primary Examiner* — Janet M Wilkens
(74) *Attorney, Agent, or Firm* — Ryndak & Suri

(57) ABSTRACT

In one aspect, an improved locking mechanism for a mobile folding table is provided, permitting convenient access near the top of the folded table to a manual actuator for unlocking the table from a folded configuration. In another aspect, an improved lift-assisting mechanism for a mobile folding table is provided, with a clutch that engages the lift-assisting mechanism only when the table top halves are at an angle from the vertical that is equal to or larger than a predetermined angle. These two aspects may be advantageously and synergistically combined in the same mobile folding table.

7 Claims, 7 Drawing Sheets

MOBILE FOLDING TABLE WITH IMPROVED LOCKING AND LIFT-ASSISTING MECHANISMS

FIELD OF THE INVENTION

The present invention relates to an improved locking mechanism for locking a mobile folding table in a closed position for moving and storing the table, and to an improved lift-assisting mechanism for aiding a user in folding a mobile folding table only up to a predetermined angle of the table top from the vertical direction.

BACKGROUND OF THE INVENTION

In settings where tables frequently need to be transferred between use and storage or from one use location to another, such as institutional settings, it is desirable to have mobile folding tables that are quickly convertible between a stationary, unfolded configuration for use and a mobile, folded configuration for movement and storage. As the table top sections of a mobile folding table can be quite heavy, lift assisting mechanisms which may be, for example, pressurized gas cylinders and/or torsion bars, are typically employed to assist a user in lifting the table top into a folded configuration. During movement and storage of the table, it is also advantageous to automatically retain the table top in a fully folded configuration so that the table remains compact. However, if the force provided by the lift-assisting mechanism is alone great enough to retain the table top in a fully folded configuration against the weight of the table top and/or other unintended forces, it may be unduly difficult for a user to oppose the lift-assisting force to unfold the table for use.

From present attempts to address this problem, it is known to employ a passive locking mechanism to retain the table in a fully folded configuration. Typically, the locking mechanism is selectively disengageable by a user applying a relatively small transverse force, allowing the table top to be lowered into an unfolded configuration. When the table is in the folded configuration and the locking mechanism is engaged, the engaged components of the mechanism are often located a considerable distance below the table center, to provide enough leverage to avoid undue stresses on the locking mechanism. However, it has been found that a locking mechanism located substantially below the folded table center is awkward to reach and thus difficult to disengage while at the same time controlling the lowering of the table into an unfolded position. This awkward operation unduly inconveniences and could risk injuring a table user.

A need therefore exists for a mobile folding table that can be comfortably and safely disengaged from a folded and locked configuration and lowered into an unfolded configuration for use.

BRIEF SUMMARY OF THE INVENTION

In accordance with one aspect of the invention, a mobile folding table with an improved locking mechanism is provided. The table includes a first table top half and a second table top half foldably connected to the first table top half so that the table top halves are foldable about a folding axis to and from a folded configuration, wherein the table top halves are generally vertical and generally parallel, and an unfolded configuration, wherein the table top halves are generally horizontal and generally coplanar. A first locking member is movably connected to a first foldable component of the table and operably connected to a manual actuator, which may for example be a T-handle; and a second locking member is attached to a second foldable component of the table, the second locking member adapted for locking engagement with the first locking member when the table top halves are in the folded configuration to prevent relative movement of the first and second foldable components away from each other and to prevent the movement of the table top halves toward the unfolded configuration. For example, the first foldable component may be the first table top half, and the second foldable component may be a part of the table frame that is constrained to remain generally vertical in all configurations of the table, so that when two components are locked together, the table is locked in the folded configuration.

When the table top halves are in the unfolded configuration, a generally straight edge of the first table top half opposes a generally straight edge of the second table top half to define a table centerline. The folding axis is parallel to and disposed vertically downward from the table centerline, so that when the table top halves are in the folded configuration, the generally straight edge of the first table top half and the generally straight edge of the second table top half are separated by a gap, and the manual actuator is disposed proximate the gap so that the manual actuator can be manually reached from the top of the folded table and moved to disengage the locking engagement of the first and second locking members to permit the table to be unfolded.

In one embodiment, the improved folded locking mechanism described above is provided in a table that also has a lift-assisting mechanism and an unfolded locking mechanism to prevent the lift-assisting mechanism from undesirably folding the table when the table is unfolded for use. If the manual actuator is connected to the first table top half, the unfolded locking mechanism may include a center locking bar movably connected to the second table top half proximate the table centerline, the locking bar selectively engageable to a latch member that is fixed with respect to the first table top half when the table is in the unfolded configuration to prevent the table from being folded. By connecting the manual actuator and center locking bar to opposite table top halves, impingement of or obstruction of manual access to either mechanism by the other is conveniently avoided.

In accordance with another aspect of the present invention, a mobile folding table with an improved lift assisting mechanism is provided. The table includes a first table top half and a second table top half foldably connected to the first table top half so that the table top halves are foldable about a folding axis to and from a folded configuration and an unfolded configuration, the table top halves being generally horizontal and generally coplanar in the unfolded configuration and being generally vertical and generally opposed in the folded configuration. The lift assisting mechanism has a first end and a second end and is configured to provide an extending force tending to extend the ends apart from each other. The first end of the lift assisting mechanism is directly connected to a first component of a folding linkage of the table such that it is always engaged for applying the extending force to the first component. For example, the first end of the lift assisting mechanism may be pivotally attached to the first component. The second end of the lift assisting mechanism is connected to a second component of the folding table linkage via a clutch, which may comprise a slotted member slidingly retaining a pin attached to the second end of the lift assisting mechanism. The first and second components are configured so that extending the lift assisting mechanism to move the first and second components apart from each other causes the table top halves to fold toward the folded configuration. The clutch is configured so that the lift assisting mechanism transmits a force to urge the first and second components apart from each other only when the table top halves are disposed at an angle from the vertical direction that is larger than a predetermined angle.

In one embodiment, the table with improved lift assisting mechanism also includes the improved folded locking mechanism described above. Conveniently, the manual actuator of the improved folded locking mechanism being accessible at the top of the folded table permits a user to manually disengage the locking mechanism to allow the table to settle to the partially unfolded angle at which the lift-assisting pistons are engaged, while standing in an advantageous location for controlling the settling of the table to the partially unfolded angle under the weight of the table top halves.

DETAILED DESCRIPTION OF THE INVENTION

With reference to the Figures generally, a mobile folding table 10 incorporating an improved folded locking mechanism 12 according to the invention for retaining table 10 in a folded configuration is described in this section. According to another aspect of the present invention discussed in this section, table 10 includes an improved lift-assisting mechanism, which may advantageously be combined with improved folded locking mechanism 12. According to yet another aspect of the present invention discussed in this section, table 10 additionally includes an unfolded locking mechanism 14 for retaining table 10 in an unfolded configuration.

Figure 1:
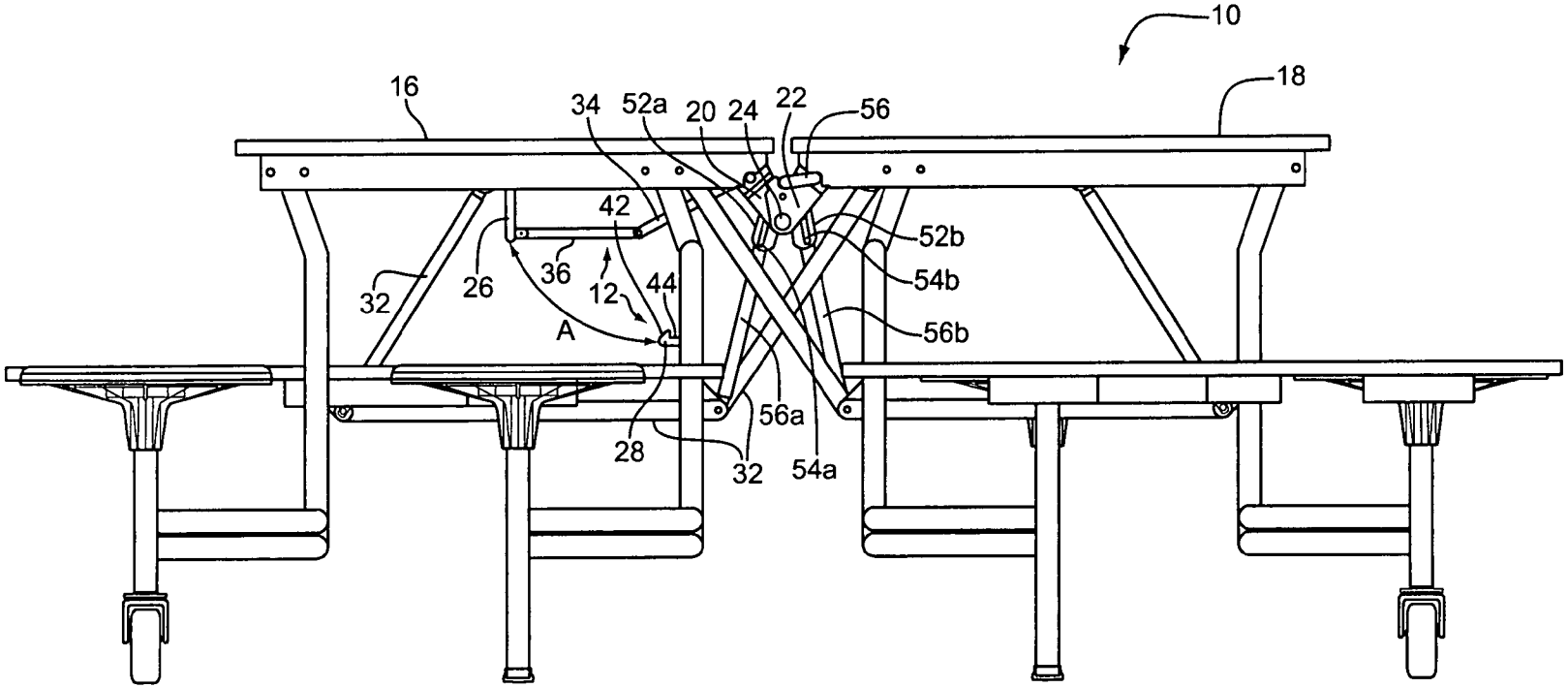
FIG. 1 is a side view of a mobile folding table with an improved locking mechanism according to the invention.
Figure 1A:
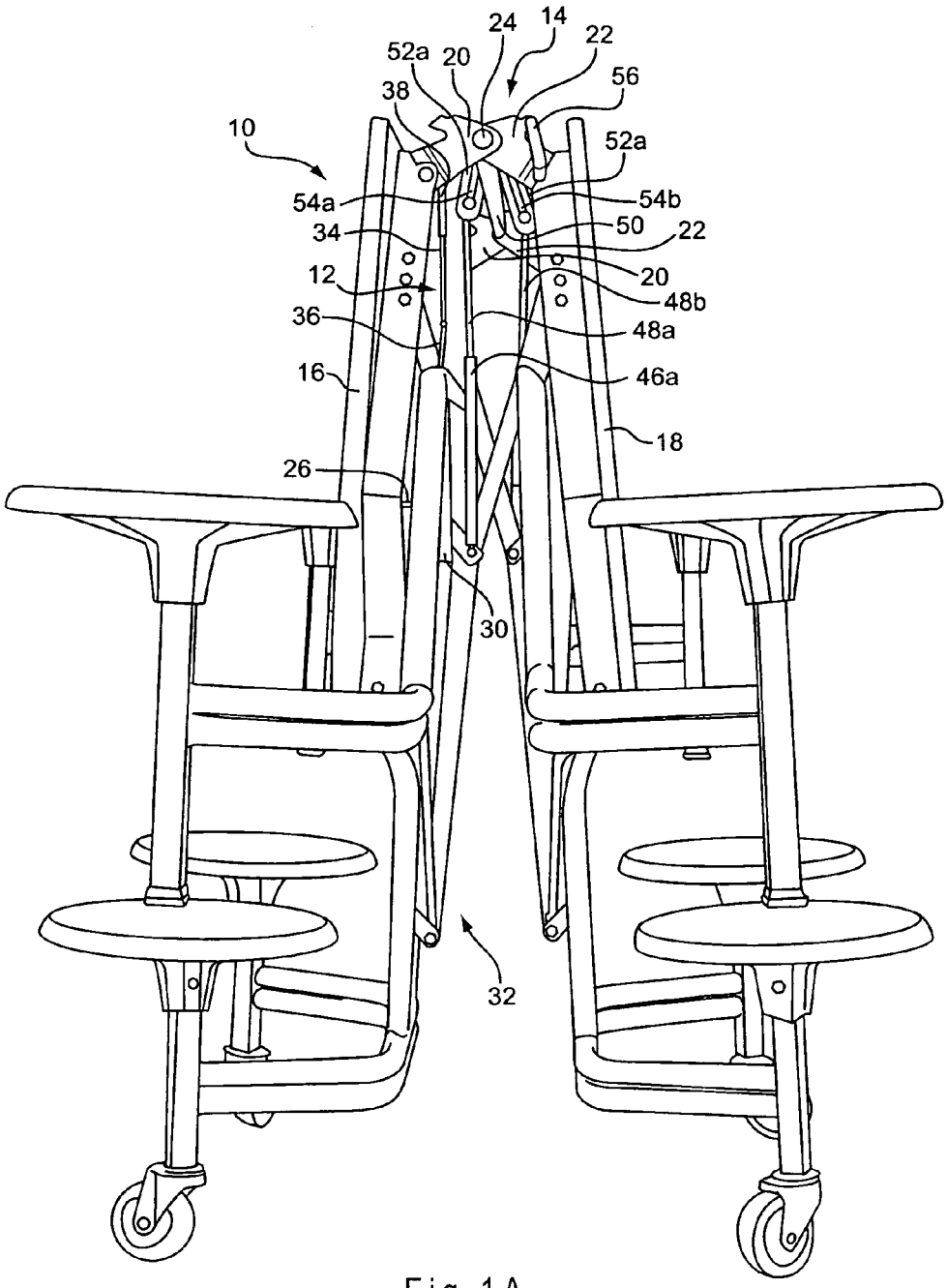
FIG. 1*a* is a side view of the mobile folding table shown in FIG. 1, with alternative seating, shown in the folded configuration.
Figure 1B:
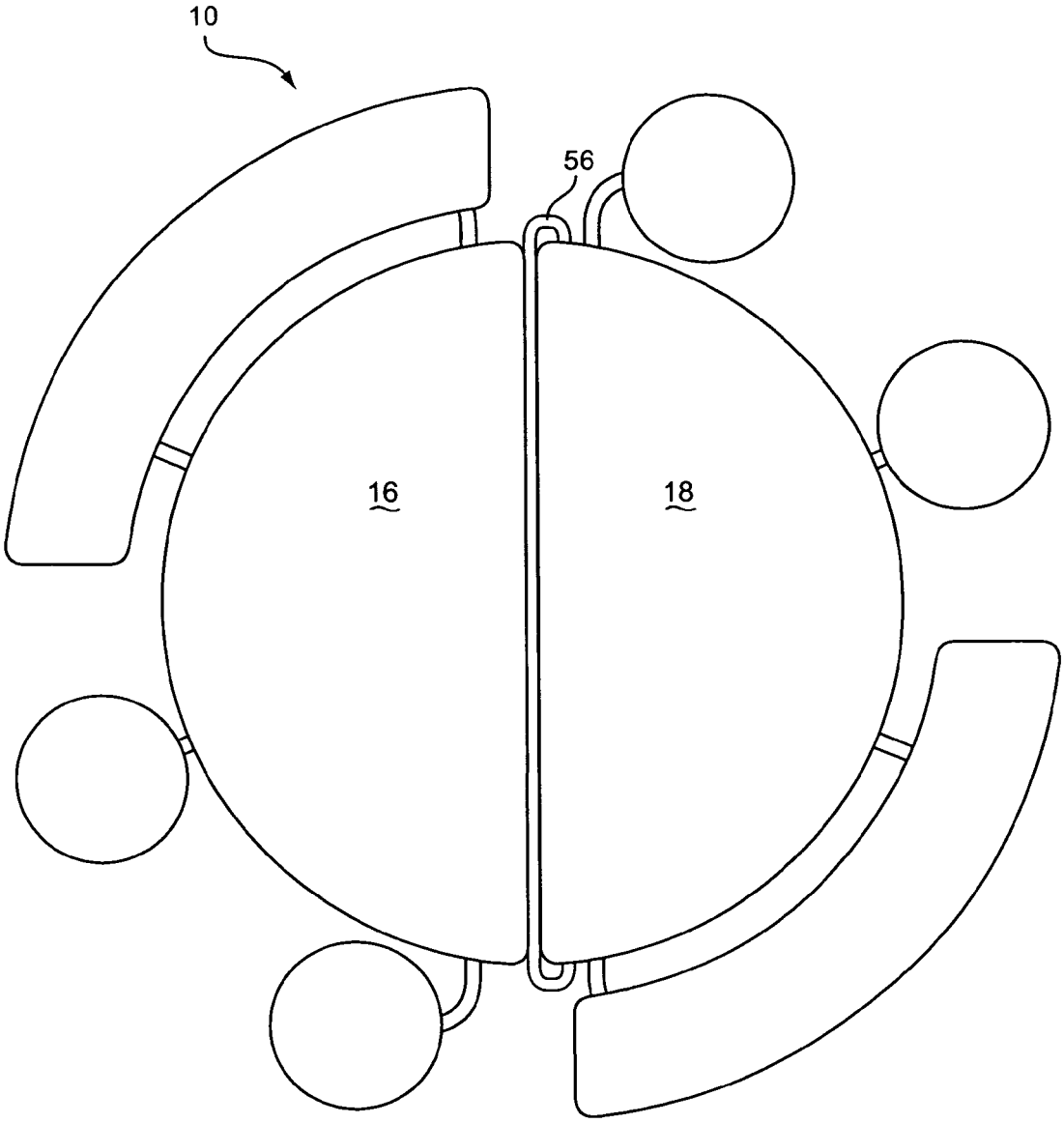
FIG. 1*b* is a top view of the mobile folding table shown in FIG. 1.
Figure 1C:
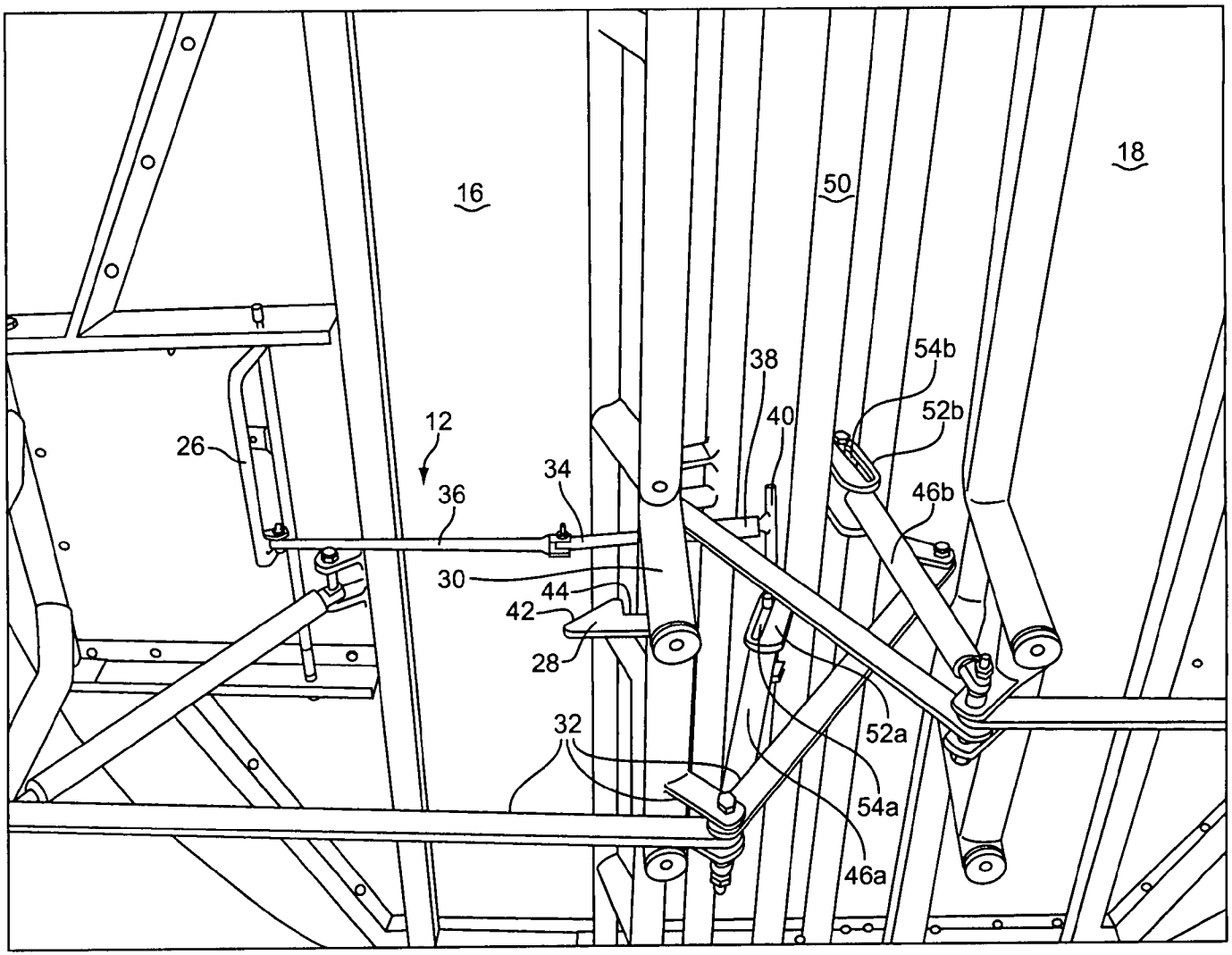
FIG. 1*c* is a bottom perspective view of the locking mechanism shown in FIG. 1, incorporated in a mobile folding table.

Referring to FIGS. 1, 1*b*, and 1*c*, table 10 is shown in side view, top view, and fragmentary bottom perspective view, respectively, in its unfolded configuration for use. As shown in FIGS. 1 and 1*b*, table 10 includes a left table top half 16 and a right table top half 18, hingedly connected to each other for folding into a vertical configuration for movement and storage. In the unfolded configuration, opposed, generally straight edges of table top halves 16 and 18 meet to define a centerline C. In the illustrated embodiment, a small gap g separates halves 16 and 18 in the unfolded configuration, although it should be noted that it is within the scope of the invention for halves 16 and 18 to be generally flush in the unfolded configuration. A left hinge plate 20 attached to left table top half 16 and a right hinge plate 22 attached to right table top half 18 are connected for independent pivotal motion about a center bar 24. As shown in FIG. 1, folded locking mechanism 12 includes a locking bar 26 pivotally connected to the bottom of left table top half 16. Arrow A indicates the general path of locking bar 26 towards a locking latch 28 during folding. Locking latch 28 is attached to a vertical frame member 30, which is hidden in FIG. 1 but seen in FIG. 1*c*, frame member 30 itself being pivotally connected to the bottom of left table top half 16 but constrained to remain generally vertical by folding linkage 32 throughout folding and unfolding. In this manner, when bar 26 is in locking engagement with locking latch 28, table 10 is retained in the fully folded configuration shown in FIG. 1*a*. It should be noted that locking latch 28 may alternatively be attached to the bottom of right table top half 18 within the scope of the invention. However, attaching latch 28 to right table top half 18 would place it further from left table top half 16 than in the illustrated embodiment, thus requiring either latch 28 or locking bar 26 to be longer and increasing material usage and table weight, as well as making it more difficult to avoid interference between moving table parts. Therefore, attaching latch 28 to vertical frame member 30 is preferred.

Figure 5:
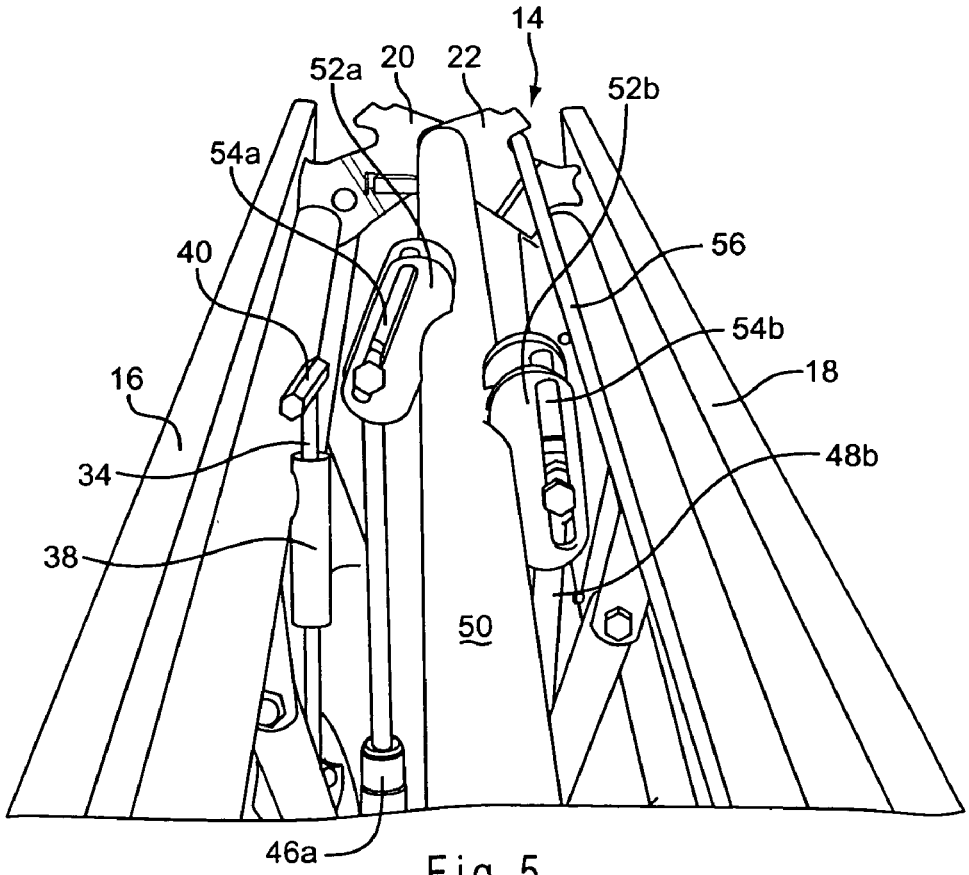
FIG. 5 is a top-side perspective fragmentary view of a mobile folding table showing the location of a manual actuator of a locking mechanism according to the invention incorporated into the table.

With reference to FIGS. 1 and 1*c*, locking mechanism 12 includes an actuator member 34 and a connecting link 36 in addition to locking bar 26. Actuator member 34 is slidably connected to left table top half 16 within sleeve 38, which is fixedly attached to the bottom of left table top half 16. For example, sleeve 38 may be welded to a fixed bar as best seen in FIG. 5. Connecting link 36 is pivotally attached to actuator member 34 and to locking bar 26. In this manner, when table 10 is in the folded configuration, locking bar 26 may be pivotally lifted out of locking engagement with latch 28 by simply pulling on a T-handle 40 of actuator member 34, and then table 10 may be lowered into the unfolded configuration.

Figure 2:
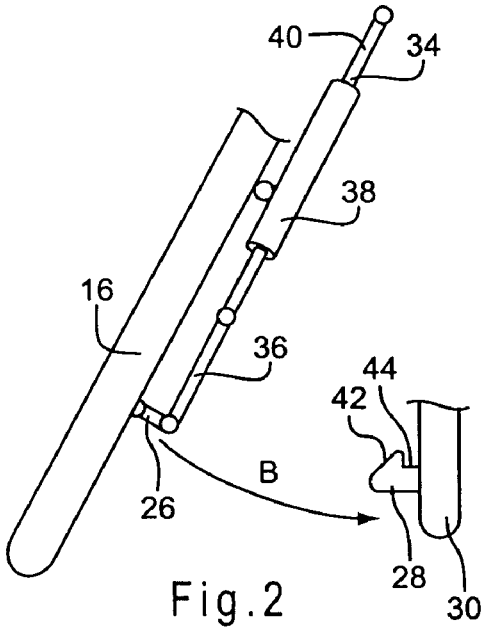
FIG. 2 is a fragmentary side schematic illustration of a locking mechanism of the present invention shown in a partially folded table configuration.
Figure 3:
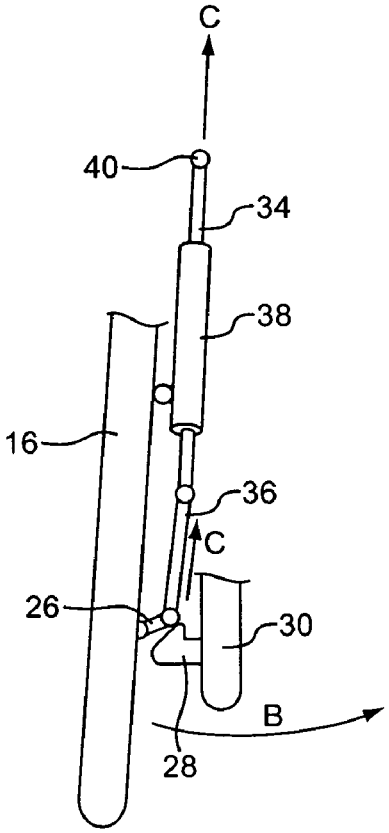
FIG. 3 is a fragmentary side schematic illustration of the camming action of a locking mechanism of the present invention just before locking engagement.
Figure 4:
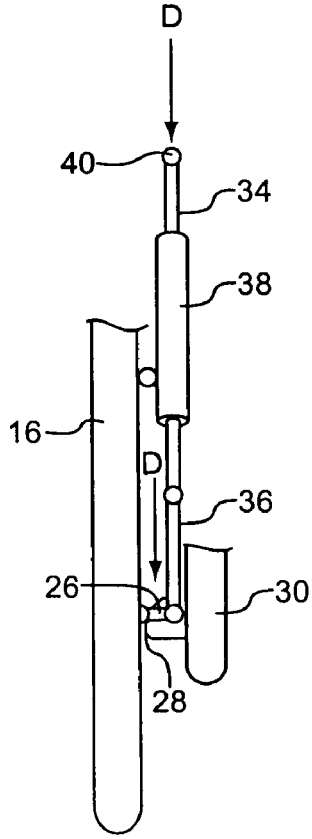
FIG. 4 is a fragmentary side schematic illustration of a locking mechanism of the present invention in locking engagement in a fully folded table configuration.

On the other hand, manual actuation is not required to engage locking mechanism 12; rather, locking mechanism 12 automatically engages upon folding as illustrated schematically in FIG. 24. Referring to FIG. 2, locking mechanism 12 is shown in the partially folded table configuration, with fragmentary portions of left table top half 16 and vertical frame member 30 shown as context. Arrow B indicates the general arcuate path followed by locking bar 26 towards latch 28 during folding. Turning to FIGS. 3 and 4, the camming action of locking mechanism 12 is illustrated; in particular, locking bar 26 is automatically forced upward by a camming portion 42 of latch 28, as indicated by arrow C, and then falls into a notch 44 of latch 28 by the force of gravity, as indicated by arrows D, where locking bar 26 is held in locking engagement with latch 28 until T-handle 40 is pulled. As seen in FIG. 5, T-handle 40 is easily accessible for manual pulling at the top of table 10 near the midpoint of center bar 24 when table 10 is in the folded configuration. This allows a user to disengage locking mechanism 12 while standing near the center of table 10, a convenient position for stabilizing left table top half 16 as it is lowered into the unfolded configuration.

Figure 6:
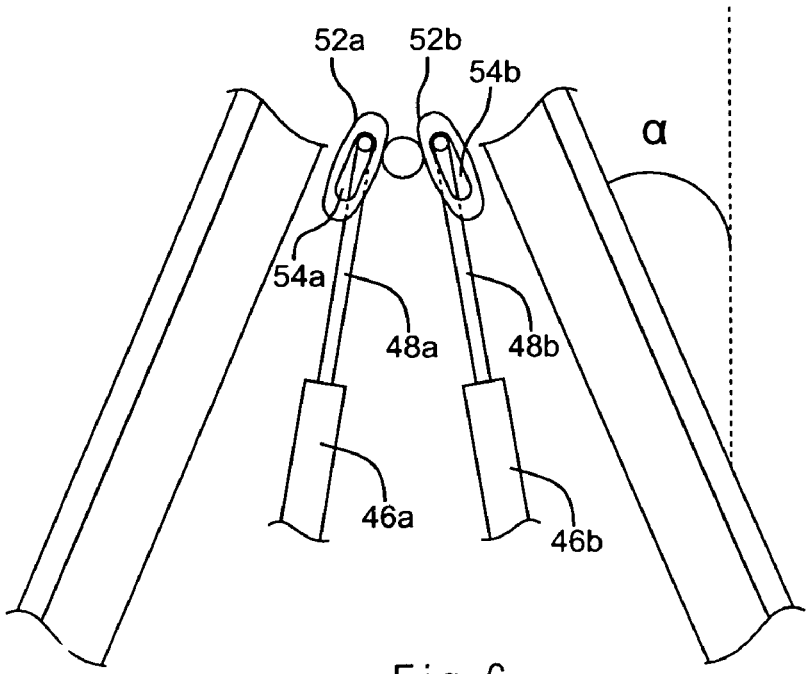
FIG. 6 is a fragmentary schematic side illustration of a partially folded table in which a pair of fully extended lift-assisting piston-cylinder assemblies have initially engaged a clutching mechanism according to another aspect of the invention.
Figure 7:
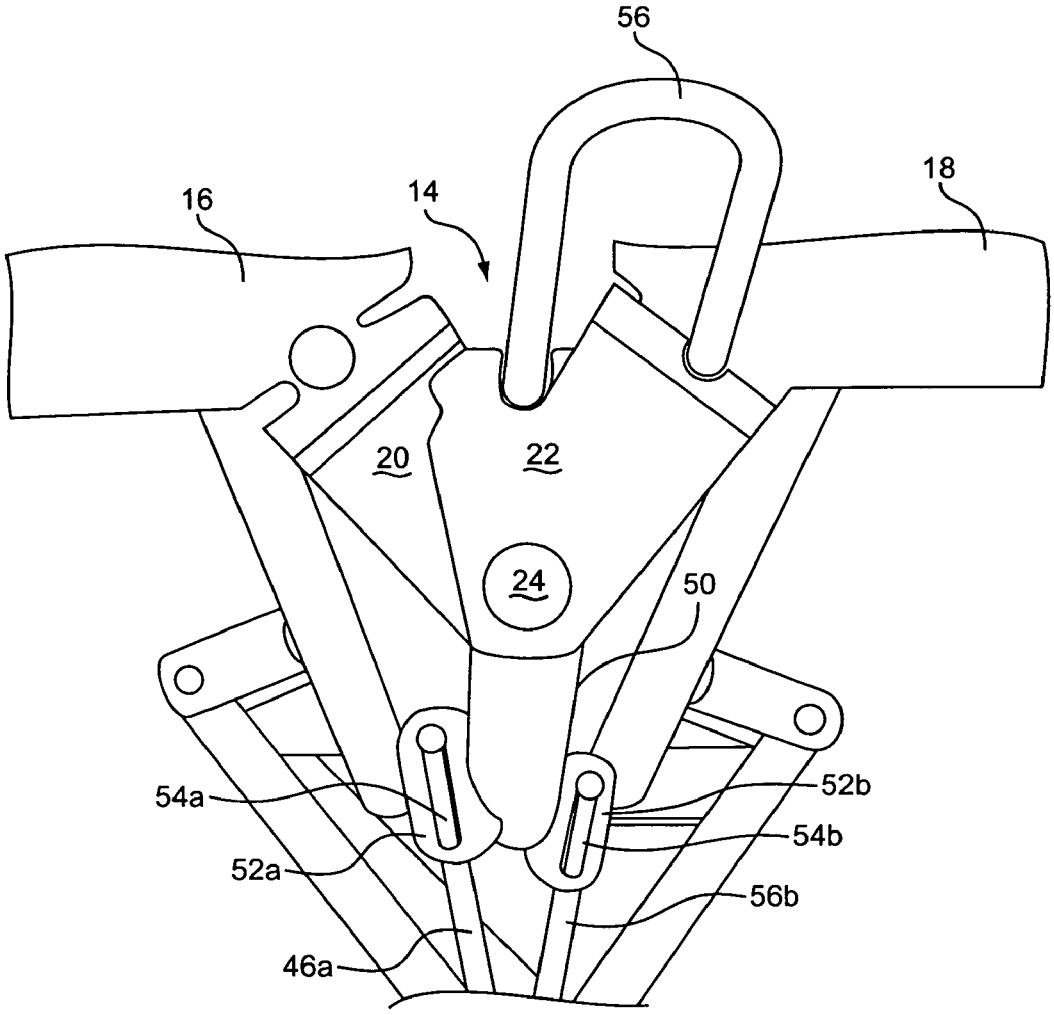
FIG. 7 is a fragmentary side-bottom perspective view of a locking bar according to another aspect of the invention engaged with hinge plates to lock a folding table in an unfolded configuration.

In accordance with another aspect of the present invention, with reference to FIGS. 1*c*, 5 and 6, table 10 includes an improved lift assisting mechanism for aiding a user in lifting table top halves 16 and 18 into the folded configuration and in stably lowering table top halves 16 and 18 from the folded to the unfolded configuration. The lift assisting mechanism may be any suitable mechanism to provide a lift assisting force, including, for example, spring mechanisms and pressurized piston-cylinder mechanisms. In the illustrated embodiment, cylinder assemblies 46*a* and 46*b* are configured to provide an upward lifting force to center bar 24 via pistons 48*a* and 48*b*. Pistons 48*a* and 48*b* are connected to a center sleeve 50, which is disposed to be freely rotatable around center bar 24, by sliding engagement of the ends of pistons 48*a* and 48*b* with clutches 52*a* and 52*b*, which are fixedly attached to center sleeve 50. Preferably, cylinder assemblies 46*a* and 46*b* are high-speed cylinder assemblies; i.e., they are free of internal forces that oppose rapid extension of pistons 48*a* and 48*b*. High-speed cylinder assemblies are discussed in more detail in co-pending U.S. patent application Ser. No. 12/455,204, entitled "Mobile Folding Table with High-Speed Cylinder Lift-Assist and Stabilizer Mechanism," the disclosure of which is hereby incorporated by reference.

During initial folding of table 10, pressurized gas in cylinders 46*a* and 46*b* provides a force tending to extend pistons 48*a* and 48*b*, which press against the top ends of clutch slots 54*a* and 54*b* to provide a lifting force to center sleeve 50. However, pistons 48*a* and 48*b* become fully extended before table 10 is fully folded, in a partially folded configuration in which table top halves 16 and 18 are at an angle $\alpha$ with respect to the vertical, as illustrated schematically in FIG. 6. At this point, the ends of pistons 48*a* and 48*b* lose contact with the top ends of clutch slots 54*a* and 54*b* during unassisted manual folding of table 10 between the partially and fully folded configurations, and the ends of pistons 48*a* and 48*b* slide downward in clutch slots 54*a* and 54*b*, as indicated by their final positions toward the bottoms of slots 54*a* and 54*b* shown in FIG. 5. The present inventors found it beneficial for pistons 48*a* and 48*b* to be fully extended at an angle $\alpha$ below which the weight of table top halves 16 and 18 provides relatively little to no downward force on center sleeve 50, so that it is relatively easy to perform the remaining folding manually. Conversely, if pistons 48*a* and 48*b* remained engaged all the way to the fully folded configuration of the table, it would be relatively difficult to overcome the lifting force of pistons 48*a* and 48*b* when initially unfolding the table through table angles less than $\alpha$, when the weight of table top halves 16 and 18 provides less lowering assistance. The preferred angle $\alpha$ depends on many factors, including the weight and weight distribution of table top halves 16 and 18, but for a typical table, a may advantageously be set at about 25-30 degrees.

Given that the initial lowering of table top halves 16 and 18 to angle $\alpha$ is unopposed by lift assisting forces according to the present invention, a synergistic relationship exists between the improved locking mechanism 12 and the improved lift assisting and clutch mechanism of the present invention. That is, the placement of T-handle 40 near the top and center of folded table 10 permits a user to disengage locking mechanism 12 while standing in a convenient position for controlling the initial free fall of table 10 into the unfolded configuration, prior to engagement of pistons 48*a* and 48*b* with clutch slots 54*a* and 54*b*.

In yet another aspect of the present invention, table 10 may further include unfolded locking mechanism 14 in addition to improved folded locking mechanism 12 and any suitable lift assisting mechanism. Unfolded locking mechanisms are typically used in conjunction with lift assisting mechanisms, to retain folding tables in the unfolded configuration during use and to prevent undesired folding of the table by the lift assisting mechanisms. In the illustrated embodiment, unfolded locking mechanism 14 includes a center locking bar 56 that is pivotally mounted to right table top half 18 and configured to selectively engage a slot in left hinge plate 20 to prevent rotational movement of left table top half 16 with respect to right table top half 18 toward the folded configuration from being undesirably caused by the lift assisting mechanism when the table is unfolded for use. According to the present invention, center locking bar 56 and T-handle 40 are advantageously connected to opposite halves of table 10 to avoid impingement of either mechanism by the other.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A mobile folding table with an improved locking mechanism, comprising:

a first table top half;

a second table top half foldably connected to the first table top half so that the table top halves are foldable about a folding axis to and from a folded configuration, wherein the table top halves are generally vertical and generally parallel, and an unfolded configuration, wherein the table top halves are generally coplanar and generally horizontal;

a first locking member movably connected to a first foldable component of the table and operably connected to a manual actuator; and a second locking member attached to a second foldable component of the table, the second locking member adapted for locking engagement with the first locking member when the table top halves are in the folded configuration to prevent relative movement of the first and second foldable components away from each other and to prevent the movement of the table top halves toward the unfolded configuration;

wherein, when the table top halves are in the unfolded configuration, a generally straight edge of the first table top half opposes a generally straight edge of the second table top half to define a table centerline, and wherein the folding axis is parallel to and disposed vertically downward from the table centerline so that when the table top halves are in the folded configuration, the generally straight edge of the first table top half and the generally straight edge of the second table top half are separated by a gap, and the manual actuator is disposed proximate the gap so that the manual actuator can be manually reached from the top of the folded table and moved to disengage the locking engagement of the first and second locking members to permit the table to be unfolded.

2. The table of claim 1, wherein the first foldable component of the table is the first table top half, and the second foldable component is pivotally connected to the first table top half and constrained to remain generally vertical as the table is folded and unfolded, so that locking the first table top half to the second foldable component when the table is in the folded configuration prevents the table from being unfolded.

3. The table of claim 1, wherein the first foldable component of the table is the first table top half, further comprising a lift-assisting mechanism providing a force to aid manual lifting of the table from the unfolded configuration to the folded configuration; and a locking bar movably connected to the second table top half proximate the table centerline, the locking bar selectively engageable to a latch member that is fixed with respect to the first table top half when the table is in the unfolded configuration to prevent the table from being folded.

4. The table of claim 3, wherein the lift-assisting mechanism comprises a high-speed piston-cylinder assembly.

5. A mobile folding table with an improved lift assisting mechanism, comprising:

a first table top half;

a second table top half foldably connected to the first table top half so that the table top halves are foldable about a folding axis to and from a folded configuration and an unfolded configuration, the table top halves being generally horizontal and generally coplanar in the unfolded configuration and being generally vertical and generally opposed in the folded configuration; and a lift assisting mechanism comprising a first and a second end, the lift assisting mechanism being configured to provide an extending force tending to extend the ends apart from each other, the first end of the lift assisting mechanism being directly connected to a first component of a folding linkage of the table and the second end of the lift assisting mechanism being connected via a clutch to a second component of the folding table linkage, the first and second components configured so that moving the first and second components apart from each other causes the table top halves to fold toward the folded configuration;

wherein the clutch is configured so that the lift assisting mechanism transmits a force to urge the first and second components apart from each other only when the table top halves are disposed at an angle from the vertical direction that is larger than a predetermined angle.

6. The table of claim 5, wherein the lift assisting mechanism comprises a high-speed piston-cylinder assembly.

7. The table of claim 5, further comprising a first locking member movably connected to a first foldable component of the table and operably connected to a manual actuator; and a second locking member attached to a second foldable component of the table, the second locking member adapted for locking engagement with the first locking member when the table top halves are in a folded configuration to prevent relative movement of the first and second foldable components away from each other and to prevent the movement of the table top halves to an unfolded configuration;

wherein, when the table top halves are in an unfolded configuration, the table top halves are generally coplanar and a generally straight edge of the first table top half opposes a generally straight edge of the second table top half to define a table centerline, and wherein the folding axis is parallel to and disposed vertically downward from the table centerline so that when the table top halves are in a folded configuration wherein the table top halves are generally vertical and generally parallel, the generally straight edge of the first table top half and the generally straight edge of the second table top half are separated by a gap, and the manual actuator is disposed in the proximate the gap so that the manual actuator can be manually reached from the top of the folded table and moved to disengage the locking engagement of the first and second locking members to permit the table to be unfolded.

* * * * *